US006213439B1

(12) United States Patent
Giulie et al.

(10) Patent No.: US 6,213,439 B1
(45) Date of Patent: Apr. 10, 2001

(54) COMBINATION TABLE EASEL, SLANT BOARD AND CLIPBOARD

(76) Inventors: Jean W. Giulie; Joe D. Giulie, both of 924 Chevy Way, Medford, OR (US) 97504

( * ) Notice: Subject to any disclaimer, the term of this patent is extended or adjusted under 35 U.S.C. 154(b) by 0 days.

(21) Appl. No.: 09/457,873

(22) Filed: Dec. 8, 1999

(51) Int. Cl.[7] ..... A47B 97/04
(52) U.S. Cl. ..... 248/459; 248/460
(58) Field of Search ..... 248/444.1, 454, 248/455, 457, 459, 460, 462, 205.3

(56) References Cited

U.S. PATENT DOCUMENTS 1,724,492 * 8/1929 Manus ..... 248/460
4,105,182 * 8/1978 Jacobson ..... 248/459
5,722,628 * 3/1998 Menaged ..... 248/441.1

* cited by examiner

*Primary Examiner*—Ramon O. Ramirez
(74) *Attorney, Agent, or Firm*—Bruce H. Johnsonbaugh

(57) ABSTRACT

A combination table easel, slant board and clipboard is provided. A body having a front surface for holding working papers and the like is pivotally connected to first and second support members. The second support member may be connected to the body in at least three different angular relationships to form either a table easel, slat board or clipboard. Velcro fasteners are the preferred type of fastener. The apparatus is easily stored, shipped and handled in its clipboard configuration.

5 Claims, 8 Drawing Sheets

COMBINATION TABLE EASEL, SLANT BOARD AND CLIPBOARD

BACKGROUND AND SUMMARY OF THE INVENTION

The present invention relates generally to table easels, slant boards and clipboards. More particularly, the present invention provides a combination table easel, slant board and clipboard. The present invention may be packaged and/or stored as a clipboard and may be readily adjusted to form a table easel or slant board.

The prior art includes a variety of table easels and slant boards. For example, the Herrera U.S. design patent 399,368 dated Oct. 13, 1998 teaches a book holder including a triangular support which includes means for adjusting the angle of the book support itself. Although this patent teaches one form of table easel, the patent does not teach a table easel readily adjustable to form a slant board or a clipboard.

The prior art also includes the Jacobson U.S. Pat. No. 4,105,182 dated Aug. 8, 1978, which teaches a collapsible and portable bookstand. However, this patent does not teach or suggest an adjustable apparatus which can also be used as a slant board and/or clipboard.

The Teague U.S. Pat. No. 4,667,919 dated May 26, 1987 teaches an apparatus for supporting a clipboard at different angles. However, this device is rather complex in that it includes a supporting base having slots at various angles into which the base of the clipboard is inserted.

The present invention contrasts with the above-identified prior art in that it provides a relatively simple and easily manufactured, shipped and stored device which can readily be adjusted to form a table easel, a slant board or clipboard. The present invention uses in its preferred form Velcro connectors which allow the device to be readily adjusted into one of its three configurations and readily detached from that configuration and adjusted to one of its other end uses.

A primary object of the invention is to provide a combination table easel, slant board and clipboard which is readily adjusted from one configuration to another.

A further object of the invention is to provide a combination table easel, slant board and clipboard having a clipboard configuration which facilitates storage, shipping and handling.

Yet another object of the invention is to provide a combination table easel, slant board and clipboard having predetermined discrete angular relationships between the major components of the apparatus, whereby predetermined support angles are provided.

Yet another object of the invention is to provide in an alternate embodiment an infinite number of angular relationships between the components of the device so that the user can provide a support angle of his or her choice.

Other objects and advantages of the invention will become apparent from the following description and drawings wherein:

BRIEF DESCRIPTIONS OF THE DRAWINGS

DETAILED DESCRIPTION OF THE DRAWINGS

Figure 1:
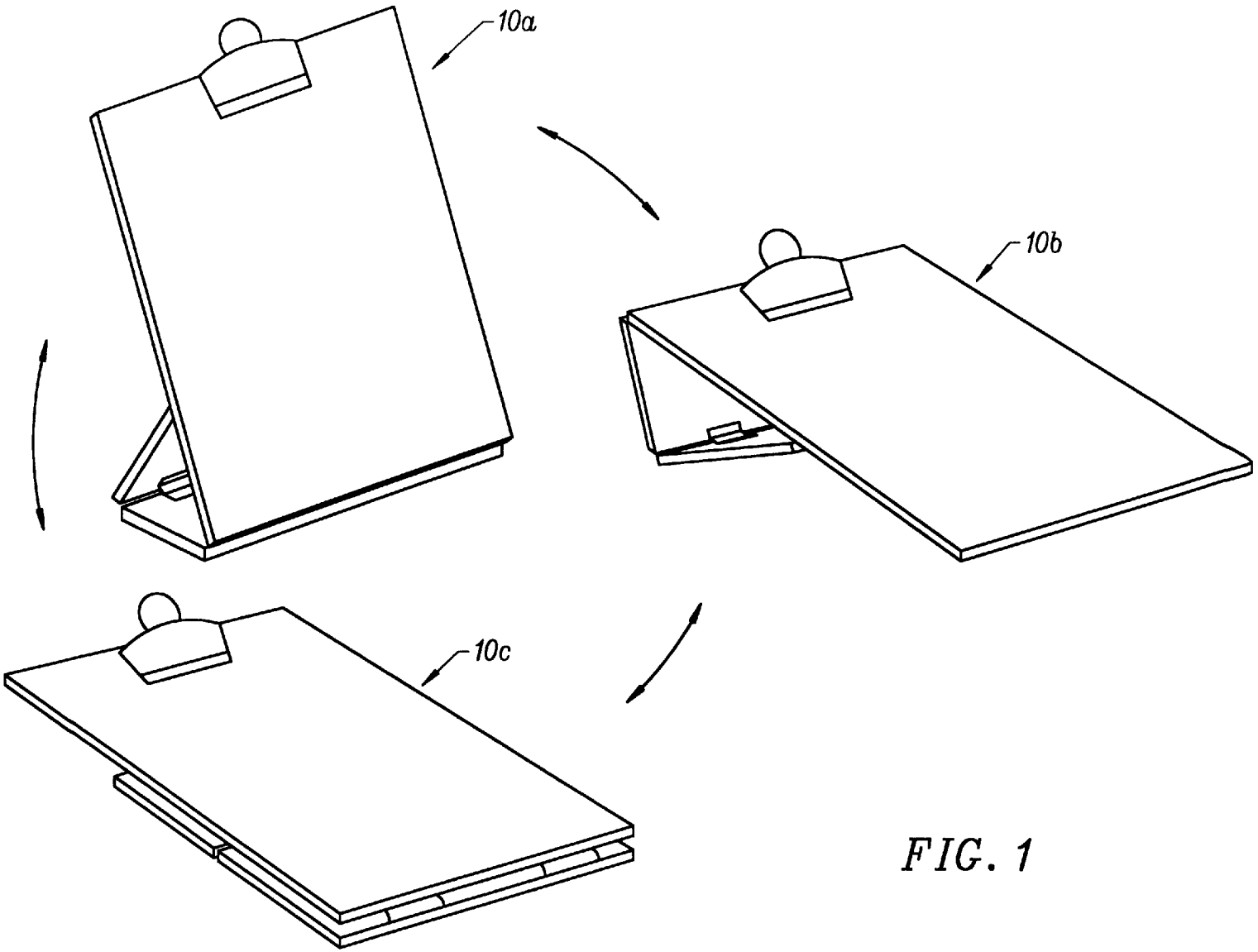
FIG. 1 is a schematic representation illustrating the three configurations of the present invention and how the invention may be readily adjusted to any of the three configurations, namely, a table easel, a slant board or a clipboard.

FIG. 1 schematically illustrates how the present invention may be adjusted to form a table easel 10*a*, a slant board 10*b* or a clipboard 10*c*. The invention is readily convertible from any one of these three configurations to either of the remaining two configurations.

Figure 2:
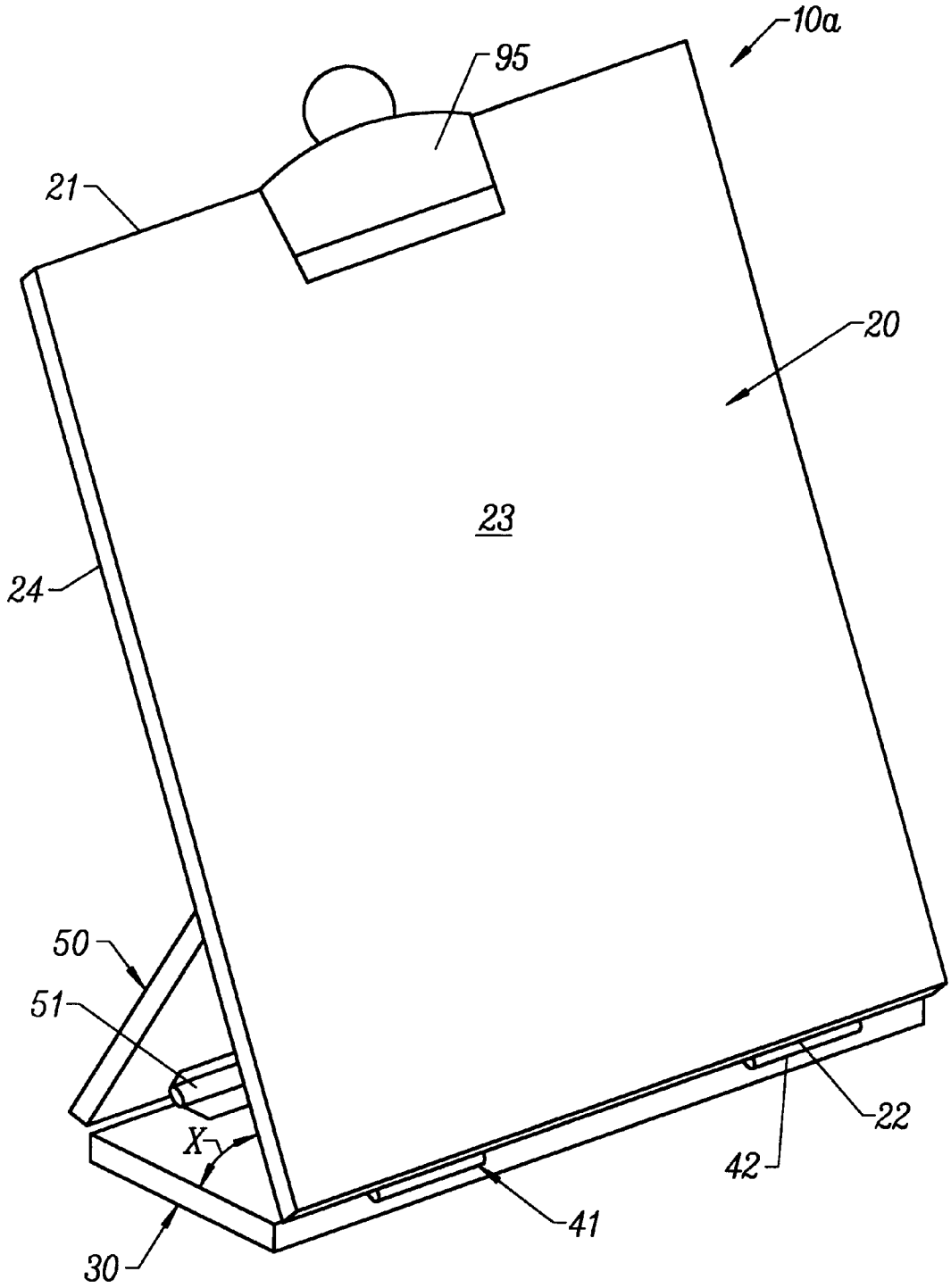
FIG. 2 is a perspective view showing the invention in its configuration as a table easel.

FIG. 2 shows table easel 10*a*. Table easel 10*a* includes a body 20 having an upper edge 21, a lower edge 22, a front surface 23 and a back surface 24. The body as illustrated in FIG. 2 is a rectangular shape, although the invention is not limited to rectangular shapes and other shapes may be utilized without departing from the spirit of this invention. The body may be made of plastic, metal, wood or other material. The preferred form of the invention utilizes plastic for the body as well as for the first and second support members described below.

A first support member 30 is pivotally connected to the lower edge 22 of body 20 by a pair of plastic hinges 41 and 42. Hinges 41 and 42 allow the first support member 30 to assume a first position shown best in FIG. 4 where first support member 30 lies adjacent the back surface 24 of body 20 and a second position shown best in FIG. 2 where it forms an angle X with the body 20. In the embodiment shown in FIG. 2, when the apparatus is configured to form a table easel 10*a*, the body 20 is positioned relative to first support member at an angle X of approximately 60°. A clip 95 of conventional design is provided to support paper materials and the like against the front surface 23.

A second support member 50 is pivotally connected to first support member 30 by hinges 51 and 52. Hinges 51 and 52 allow second support member 50 to lie parallel, and in the same plane, with first support member 30 as shown best in FIG. 4. Hinges 51 and 52 allow second member 50 to pivot relative to first member 30 and to form a triangular support for the body 20 when connected to the body as described below.

Figure 3:
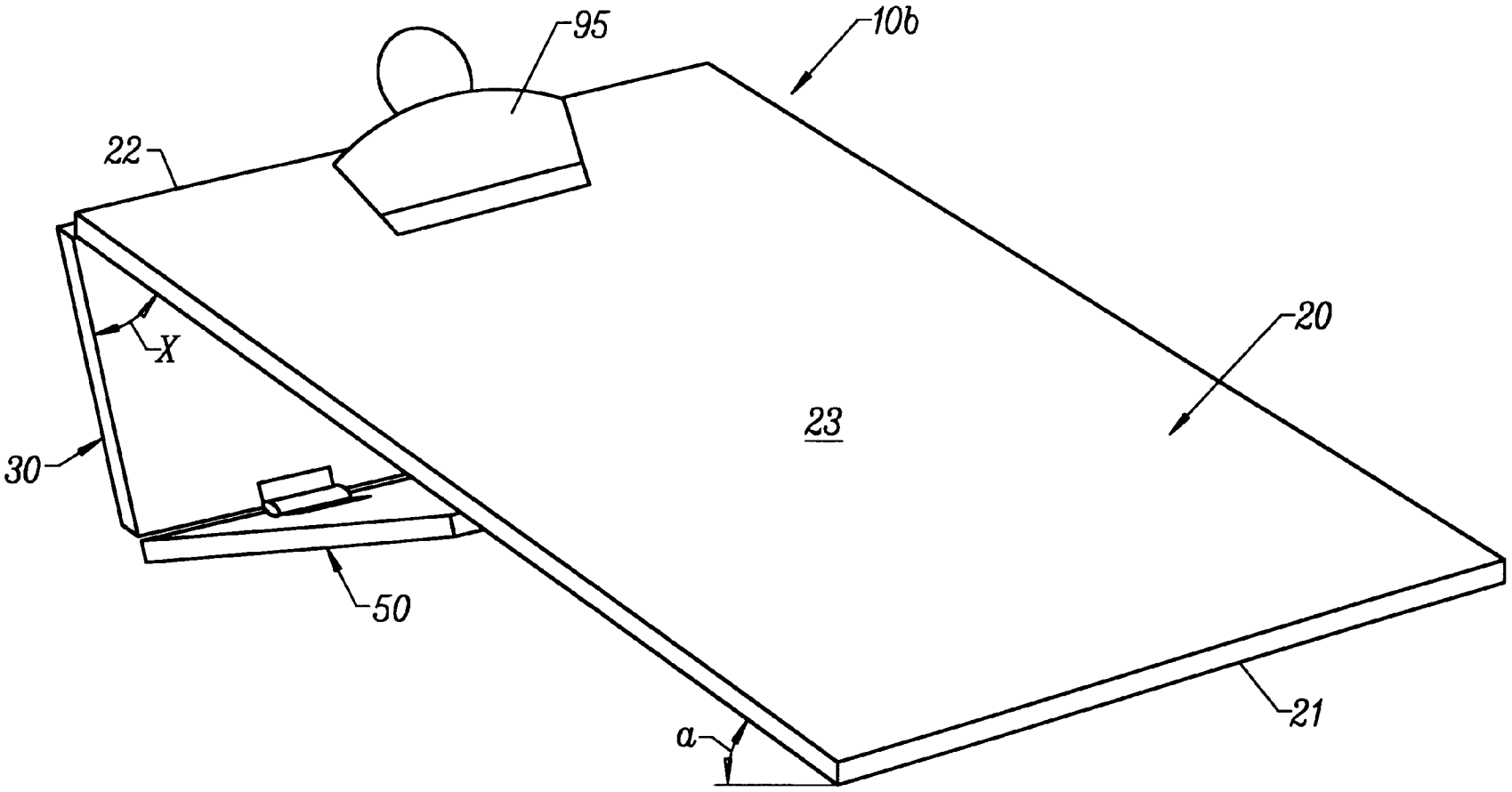
FIG. 3 is a perspective representation showing the invention in its configuration as a slant board.

FIG. 3 shows the invention after it has been adjusted to form a slant board lob. In this configuration, the "upper" and "lower" edges are reversed so that the "upper" edge 21 rests on a working surface and the "lower" edge 22 is supported in an elevated position by first support member 30 and second support member 50 forming a triangular support for body 20. The clip 95 has simply been removed from "upper" edge 21 and attached to "lower" edge 22 to support papers and other working materials on the front surface 23 of the slant board. In this configuration, first support member 30 is positioned at an angle X of approximately 45° relative to body 20. Second support member 50 is preferably mounted perpendicularly to first member 30 and supports the slant board 10*b* at an angle "a" relative to a working surface of approximately 30°.

Figure 4:
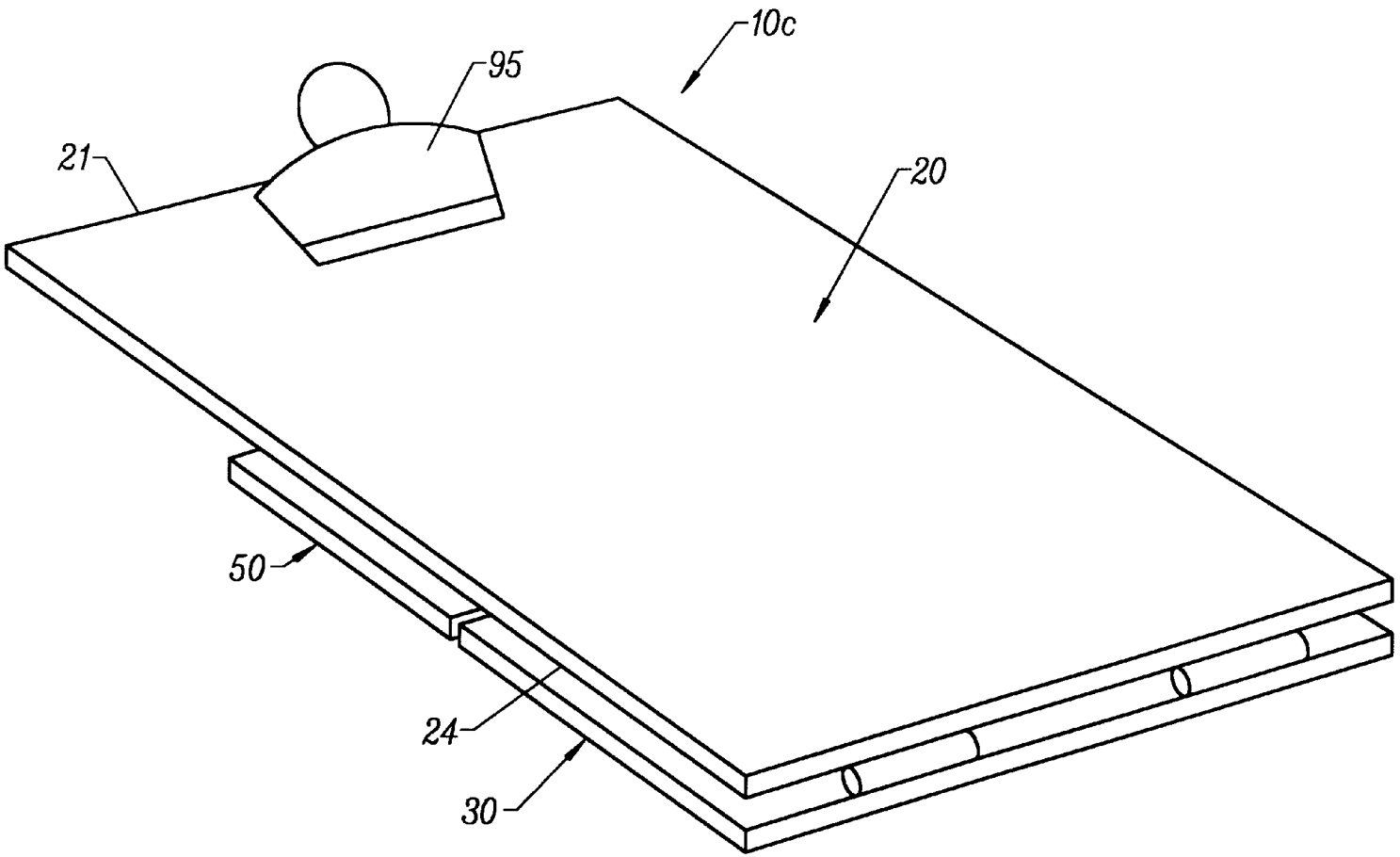
FIG. 4 is a perspective view showing the invention in its configuration as a clipboard.

FIG. 4 shows the invention in its configuration as a clipboard 10*c*. In this configuration, clip 95 is attached to the upper edge 21 of body 20. First and second support members 30 and 50 lie adjacent back surface 24. In this configuration, the invention may be easily stored or transported. To maximize the efficiency for storage or shipping, clip 95 is removed and packaged without being connected to body 20. FIG. 4 shows first and second support members 30 and 50 in their first position.

First and second support members 30 and 50 may be readily adjusted to the position shown in either FIG. 2 or FIG. 3 to form either a table easel 10*a* or a slant board 10*b*.

Figure 5:
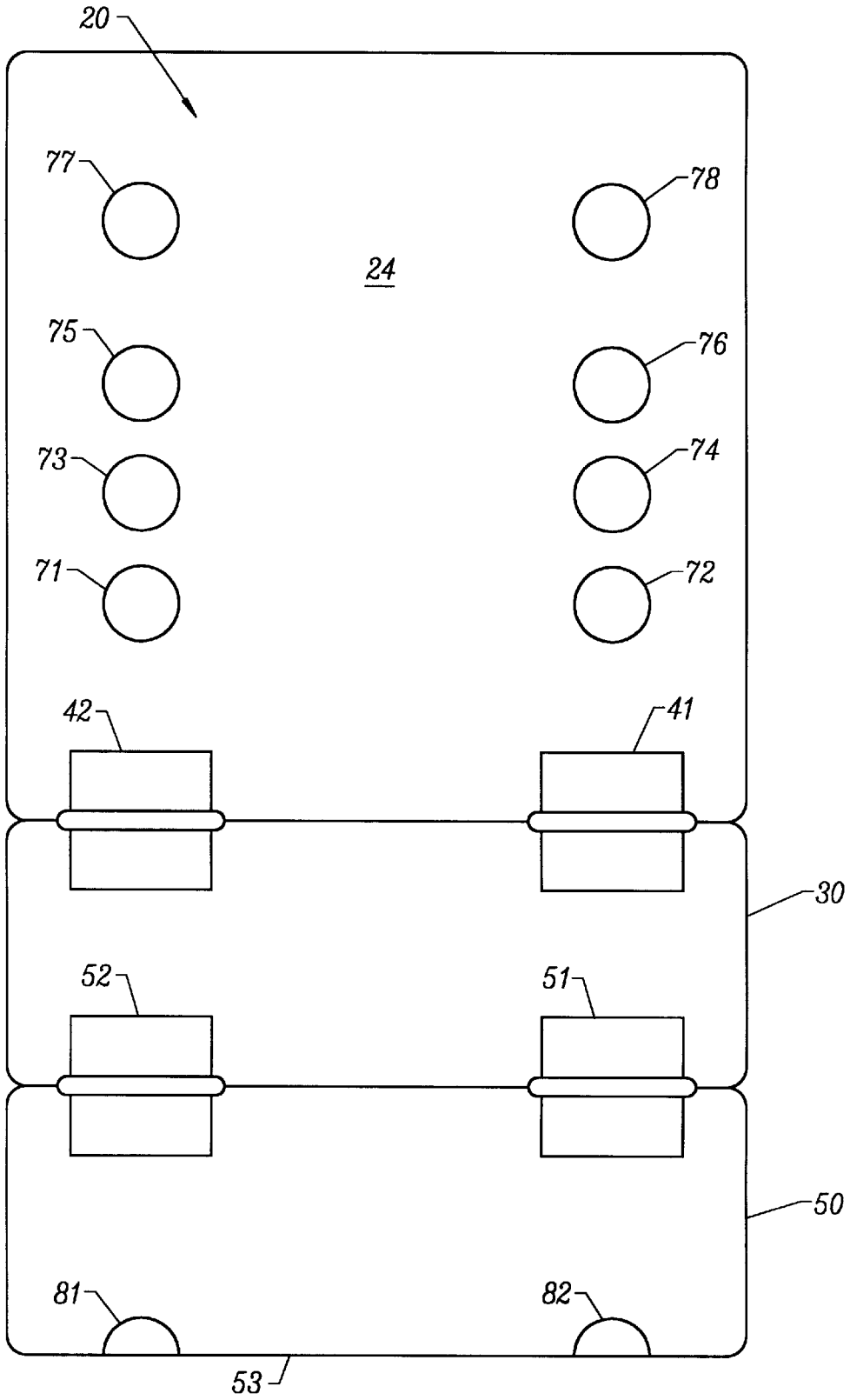
FIG. 5 is a rear elevational view showing the apparatus extended to illustrate the hinges and Velcro connectors.

FIG. 5 shows the back surface 24 of body 20 and shows the placement of a plurality of circular Velcro pieces 71–78. Velcro pieces 71–78 are placed on back surface 24 by adhesive to form four pairs 71–72, 73–74, 75–76 and 77–78.

FIG. 5 also shows first and second support members 30 and 50 rotated into an extended position where they are coplanar with body 20. In this view, the relationship of hinges 41–42 and 51–52 and support members 30 and 50 are shown clearly. Second support member 50 carries two Velcro pieces 81 and 82 along its lower edge 53. The Velcro pieces 81 and 82 are designed to connect with any one of the pairs 71–72, 73–74, 75–76 or 77–78 of Velcro pieces carried by the back surface 24 of body 20. To adjust the invention to the clipboard configuration 10*c*, the user simply rotates first and second support members 30 and 50 upwardly from the position shown in FIG. 5 to a position where Velcro pieces 81 and 82 connect with pieces 77 and 78. To form a table easel 10*a*, the user simply rotates first and second support members 30 and 50 from the position shown in FIG. 5 to a position wherein Velcro pieces 81 and 82 are in contact with either the pair 71–72 of Velcro pieces or the pair 73–74. To adjust the invention to form the slant board 10*b*, the user simply disconnects the Velcro pieces 81 and 82 from the pair 73–74 for example and connects them to pair 75–76. As used in the claims herein, the pairs of Velcro pieces 71–72 and 73–74 cooperating with Velcro pieces 81–82 form a first detachable connection means and, when so connected, the apparatus forms a table easel. As used in the claims, the Velcro pieces 75–76 carried on back surface 24 working together with Velcro pieces 81–82, carried at the lower edge 53 of second support member 50, cooperate to form a second detachable connection means forming a slant board. Similarly, as used in the claims, Velcro pieces 77–78 carried on the back surface 24 of body 20 cooperate with Velcro pieces 81–82 to form a third detachable connection means which securely holds first and second support members 30 and 50 adjacent back surface 24 in the clipboard configuration 10*c*.

Figure 6:
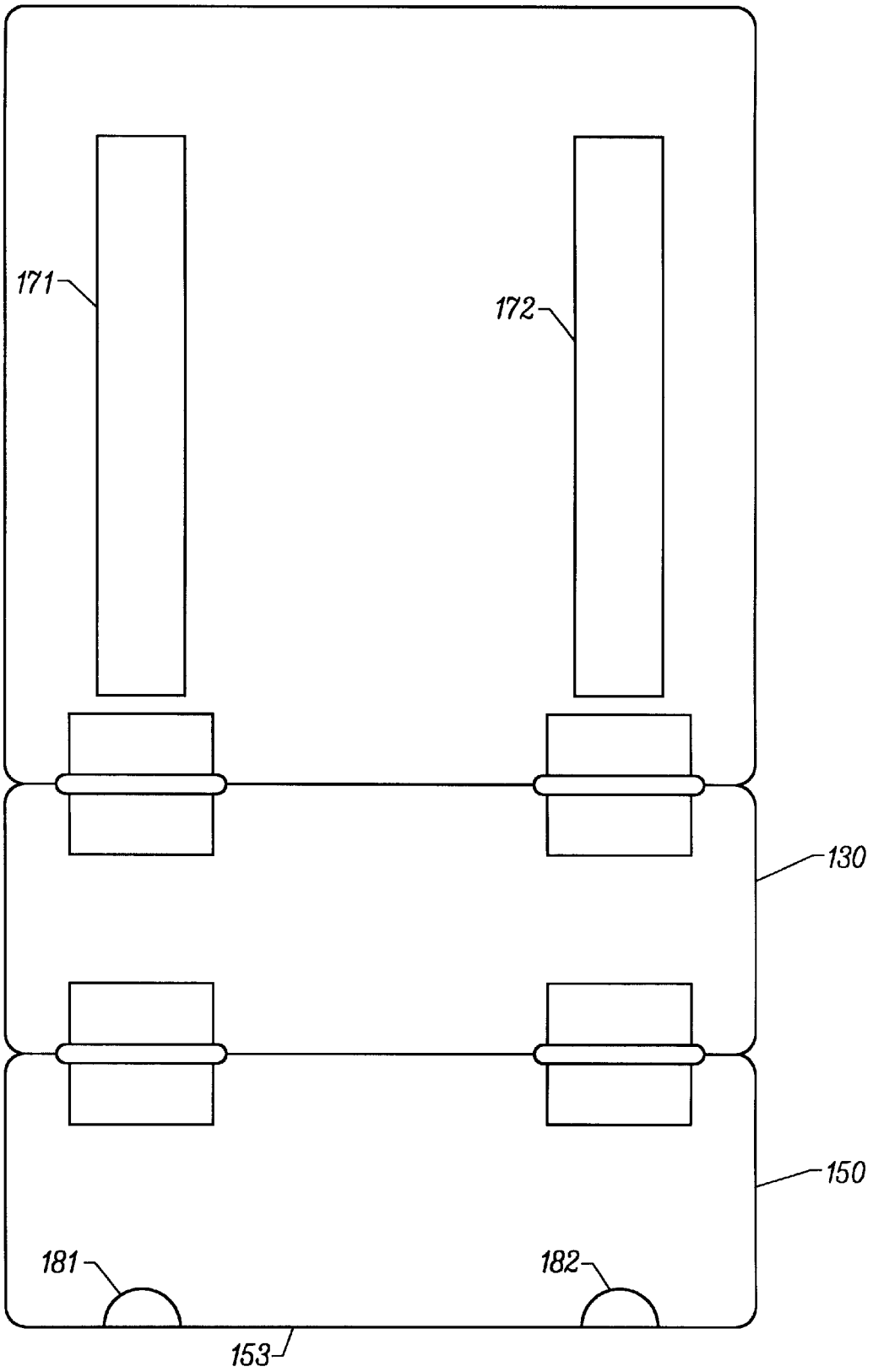
FIG. 6 is a rear elevational view of an alternate embodiment of the invention showing continuous Velcro strips mounted on the back surface of the body.

FIG. 6 shows a second embodiment of the invention wherein two continuous Velcro strips 171 and 172 are provided which cooperate with Velcro pieces 181 and 182 carried by the lower edge 153 of second support member 150 to form first, second and third connection means in a fashion similar to the embodiment illustrated in FIG. 5. However, it is clear that, in the embodiment shown in FIG. 6, an infinite variation of angular relationships may be selected by the user between said body and first and second support elements 130 and 150.

Figure 7:
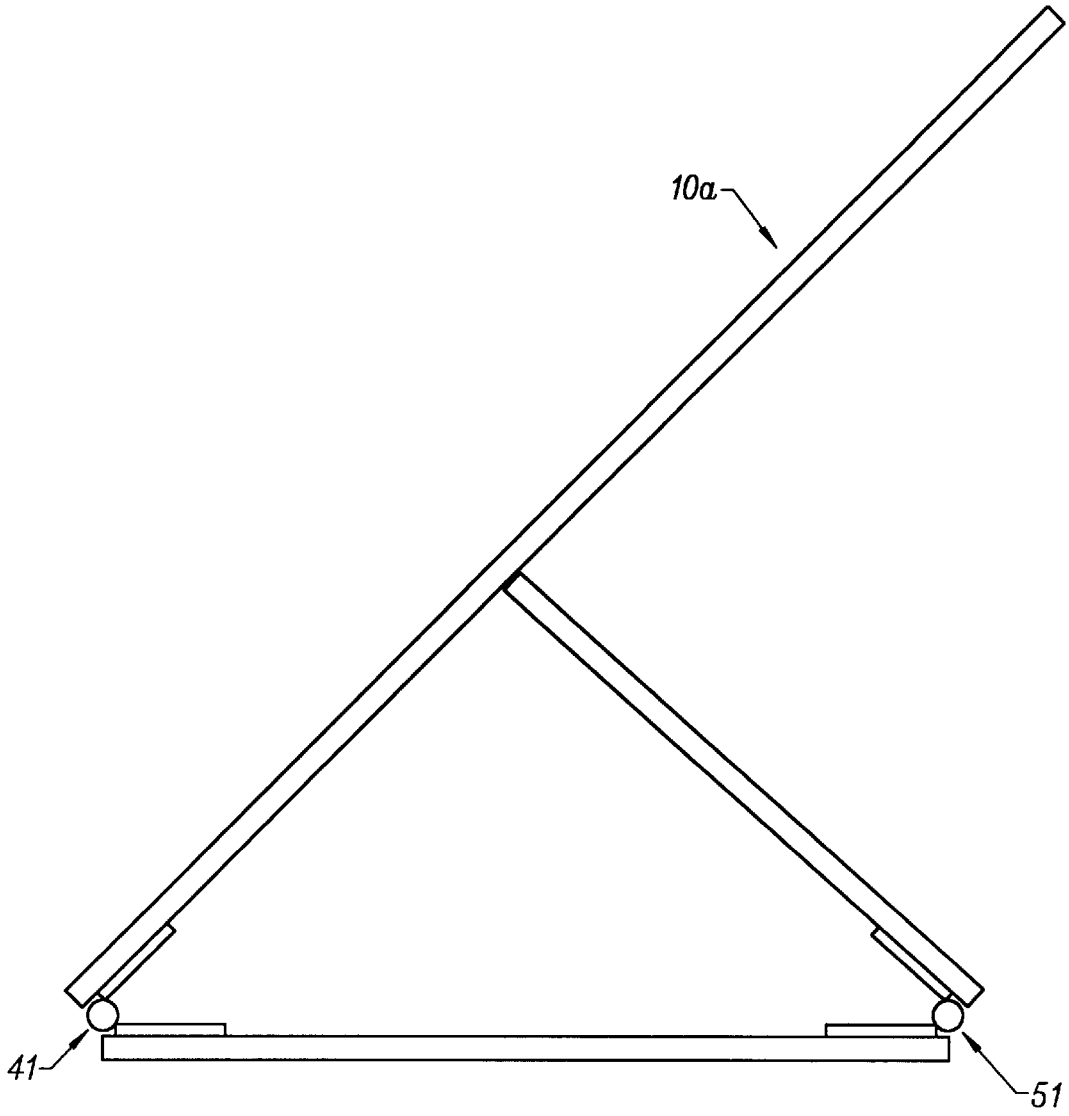
FIG. 7 is a side elevational view of the invention in its configuration as a table easel showing in greater detail the hinge configuration.

FIG. 7 is a side view of the table easel configuration of the invention showing hinges 41 and 51.

Figure 8:
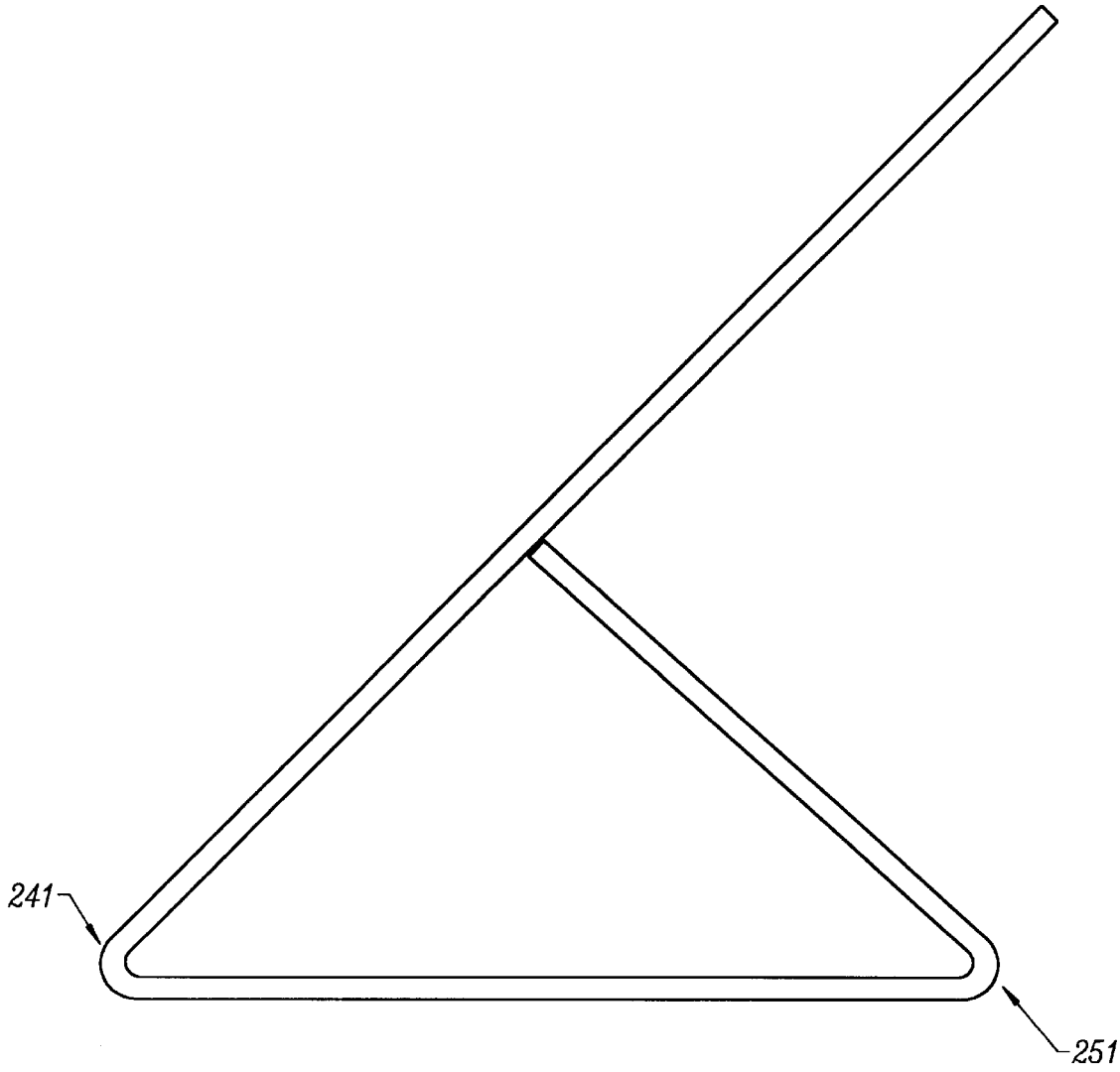
FIG. 8 is a side elevational view partially in section showing an embodiment using living hinges.

FIG. 8 shows another embodiment of the invention wherein, instead of using separate hinges, "living hinges" 241 and 251 are provided by using appropriate material known in the art such as polypropylene.

It is understood that variations in the design may be made without departing from the spirit of the invention. For example, various configurations of Velcro connection pieces or strips can be utilized. Various types of hinges may be provided to interconnect the body with first and second support elements 30 and 50 and a variety of angles may be provided between the support elements and the body.

What is claimed is:

1. An apparatus adjustable to function as either a table easel, a slant board or a clipboard, comprising:

a body, said body having an upper edge, a lower edge, a front surface and a back surface, a first support member, said first support member being pivotally connected to said lower edge of said body, and wherein said first support member pivots between a first position in which it lies adjacent said back surface of said body and a second position wherein it forms an angle X with said body, a second support member pivotally connected to said first support member, said second support member having a first position wherein it lies adjacent said back surface of said body, and first and second detachable connection means for connecting said second support member to said body, one element of said first and second detachable connection means being carried by said back surface of said body and a second element of said detachable connection means being carried by said second support member, whereby said apparatus forms a table easel when said second support member is connected to said first detachable connection means, said apparatus forms a slant board when second support member is connected to said second detachable connection means and said apparatus forms a clipboard when said first and second support members lie adjacent said back surface of said body.

2. The apparatus of claim 1 wherein said first and second detachable connection means comprises pieces of Velcro.

3. The apparatus of claim 1 further comprising third detachable connection means for holding said apparatus in the form of a clipboard with said first and second support elements lying adjacent said back surface of said body, one element of said third detachable connection means being carried by said back surface of said body.

4. The apparatus of claim 3 wherein said first, second and third detachable connection means comprise Velcro patches positioned on said back surface of said body at predetermined and discrete locations to achieve desired angular relationships between said body and said first and second support elements.

5. The apparatus of claim 3 wherein said first, second and third connection means comprise at least one continuous Velcro strip positioned on said back surface of said body to allow an infinite variation of angular relationships between said body and said first and second support elements.

* * * * *